US011634873B2

(12) United States Patent
Smith et al.

(10) Patent No.: US 11,634,873 B2
(45) Date of Patent: Apr. 25, 2023

(54) DEFORMABLE CURB BARRIER

(71) Applicant: THREE SMITH GROUP LIMITED, Elland (GB)

(72) Inventors: Luke Smith, Elland (GB); Lee Scothern, Elland (GB); Robert Metcalfe, Elland (GB)

(73) Assignee: THREE SMITH GROUP LIMITED, West Yorkshire (GB)

( * ) Notice: Subject to any disclaimer, the term of this patent is extended or adjusted under 35 U.S.C. 154(b) by 0 days.

(21) Appl. No.: 17/787,882

(22) PCT Filed: Dec. 11, 2020

(86) PCT No.: PCT/GB2020/053200

§ 371 (c)(1),
(2) Date: Jun. 21, 2022

(87) PCT Pub. No.: WO2021/123743

PCT Pub. Date: Jun. 24, 2021

(65) Prior Publication Data

US 2023/0034715 A1 Feb. 2, 2023

(30) Foreign Application Priority Data

Dec. 18, 2019 (GB) ..... 1918741

(51) Int. Cl.
*E01C 11/22* (2006.01)

(52) U.S. Cl.
CPC ..... *E01C 11/222* (2013.01)

(58) Field of Classification Search
CPC ..... E01C 9/535; E01C 9/541; E01C 11/22; E01C 11/222

(Continued)

(56) References Cited

U.S. PATENT DOCUMENTS 5,192,157 A * 3/1993 Laturner ..... E01F 15/146 404/6
6,533,250 B2 * 3/2003 Arthur ..... E01F 15/083 404/9

(Continued)

FOREIGN PATENT DOCUMENTS

DE 19848320 A1 5/2000
EP 2 088 241 A1 8/2009

(Continued)

OTHER PUBLICATIONS

Mar. 12, 2021 International Search Report issued in International Patent Application No. PCT/GB2020/053200.

(Continued)

*Primary Examiner* — Gary S Hartmann
(74) *Attorney, Agent, or Firm* — Oliff PLC

(57) ABSTRACT

A kerb barrier includes: a first barrier member having a length, the first barrier defining a cavity; and a second barrier member in the cavity of the first barrier that extends substantially along the length of the first barrier member, wherein a base of the second barrier member is fixable to a base of the first barrier member, wherein, upon side impact, a region of the first barrier member is configured to bend relative to the second barrier member about a first bending point defined by the first barrier member, wherein the first barrier member is configured to act on the second barrier member such that the region of the first barrier member and a region of the second barrier member are configured to bend about a second bending point defined by the second barrier member, wherein the second bending point is spaced apart from the first bending point.

9 Claims, 10 Drawing Sheets

(58) Field of Classification Search
USPC ..... 404/7
See application file for complete search history.

(56) References Cited

U.S. PATENT DOCUMENTS

| | | | | |
|---|---|---|---|---|
| 7,575,391 | B2 * | 8/2009 | Tarazona de La Asuncion | E01F 15/0461 188/371 |
| 10,748,461 | B2 * | 8/2020 | Fenimore | E01F 9/541 |
| 2018/0283040 | A1 | 10/2018 | McCue et al. | |
| 2019/0139467 | A1 | 5/2019 | Fenimore et al. | |

FOREIGN PATENT DOCUMENTS

| | | | |
|---|---|---|---|
| FR | 3 034 113 | A1 | 9/2016 |
| GB | 2542276 | A | 3/2017 |
| WO | 2020/096333 | A1 | 5/2020 |

OTHER PUBLICATIONS

Mar. 12, 2021 Written Opinion issued in International Patent Application No. PCT/GB2020/053200.

* cited by examiner

DEFORMABLE CURB BARRIER

The present disclosure relates to a kerb barrier, and in particular to a barrier for preventing vehicle access.

BACKGROUND

It is known to provide barriers and gates to protect equipment and demarcate areas. Such barriers and gates may be used to demarcate a path for pedestrians or motorists and/or prevent a vehicle colliding with equipment which can, for instance, cause damage to the equipment.

Vehicles, such as forklift trucks, are often driven in both forward and reverse directions. It can be challenging to provide kerb barriers that are suitable for stopping vehicles when they are travelling in either the forward direction or the reverse direction as there are different challenges associated with each as the loadings imparted to the barriers will differ.

Traditional barrier members typically have a relatively large height to provide the required structural stiffness to stop vehicles. However, with some vehicles, providing high kerb barriers is not suitable. An operator of the vehicle may position their legs on the vehicle such that their legs may be trapped between the vehicle and barrier in the event of a collision. As such, there is a need to develop a barrier that has a reduced height and able to absorb high loads associated with vehicle impact to prevent vehicles from crossing the barrier.

It is an aim of the present invention to attempt to overcome at least one of the above or other disadvantages

SUMMARY

According to the present disclosure there is provided a kerb barrier as set forth in the appended claims. Other features of the invention will be apparent from the dependent claims, and the description which follows.

According to one example, there is provided a kerb barrier comprising a first barrier member having a length, the first barrier defining a cavity; and a second barrier member in the cavity of the first barrier that extends substantially along the length of the first barrier member, wherein a base of the second barrier member is fixable to a base of the first barrier member, wherein, upon side impact, a region of the first barrier member is configured to bend relative to the second barrier member about a first bending point defined by the first barrier member, wherein the first barrier member is configured to act on the second barrier member such that the region of the first barrier member and a region of the second barrier member are configured to bend about a second bending point defined by the second barrier member, wherein the second bending point is spaced apart from the first bending point. In an undeformed state, a clearance gap is provided between a wall of the first barrier member and a wall of the second barrier member.

Previously, the traditional thinking was that providing a tight friction fit between the first barrier member and the second barrier member would provide enhanced performance. In fact, the opposite was found to be true. It had been found that the provision of multiple, abutting, elements resulted in a kerb barrier that was too stiff, and the kerb barrier fractured and failed at relatively low impact energies (e.g. less than 5,000 J). In contrast, the provision of a kerb barrier having two bending points that are separated provides a significant increase in the amount of energy that can be successfully absorbed by the kerb barrier without breaking.

The kerb barrier avoids a tight fit between first barrier member and the second barrier member, with no bonding between, thereby increasing strength of the kerb barrier. In other words, the provision of the clearance gap improves performance and strength without dramatically increasing stiffness.

In one example, the region of the first barrier member that is configured to bend is the wall of the first barrier member, and wherein, upon side impact, the wall of the first barrier member is configured to move relative to the wall of the second barrier member to contact the wall of the second barrier member.

The provision of barrier members with walls that bend relative to each other provides a system in which horizontal impacts from vehicles can be absorbed.

In one example, the first barrier member tapers from the base to a top of the first barrier member. The taper means that if a fork of a vehicle hits the kerb barrier, then the fork will be deflected upwards, diverting some horizontal energy into vertical energy. If the wheels hit the kerb barrier, then they will be lifted upwards too.

In one example, the first bending point is located at a junction of the wall and the base of the first barrier member. The provision of a bending point here enables the wall of the first barrier member to bend relative to the second barrier member.

In one example, the second bending point is located at a junction of the wall and the base of the second barrier member.

In one example, the second barrier member comprises a cavity, the kerb barrier comprising a third barrier member in the cavity of the second barrier that extends substantially along a length of the second barrier member.

The provision of a third barrier member increases the strength of the kerb barrier.

In one example of the kerb barrier, upon side impact, the second barrier member is configured to act on the third barrier member such that the region of the first barrier member, the region of the second barrier member and a region of the third barrier are configured to bend about a third bending point defined by the third barrier member, wherein the third bending point is spaced apart from the first bending point and the second bending point.

In one example, the kerb barrier comprises a plurality of fixings arranged along the length of the kerb barrier and configured to couple the first barrier member to the second barrier member and the ground.

The fixings provide a means for coupling the first barrier member to the second barrier member. Further, the fixings provide means to couple the kerb barrier to the ground.

In one example, the second barrier member comprises a polygonal hollow section.

In one example, the second barrier member comprises a cylindrical hollow section.

In use, any of these features may be combined in practice in any combination.

BRIEF DESCRIPTION OF THE DRAWINGS

Examples of the present disclosure will now be described with reference to the accompanying drawings.

DETAILED DESCRIPTION

The present disclosure relates to a kerb barrier for preventing ground vehicle access. In particular, the kerb barrier is suitable for preventing ground vehicles from accessing certain areas. In use, the kerb barrier is designed to stop a forklift truck, whether travelling in a forward or reverse direction. The kerb barrier includes a first barrier member and a second barrier member positioned within the first barrier member. In practice, the first barrier member may be considered to be an external barrier and the second barrier member may be considered to be an internal barrier.

A base of the second barrier member may be supported on and abut a base of the first barrier member. The second barrier member may be fixed to the first barrier member by fixings positioned along the length of the barrier.

Aside from the respective bases, a gap may be defined between the second barrier member and the first barrier member such that under impact the first barrier member may initially deflect relative to the second barrier member. In other words, if the barrier is impacted, then the barrier will initially deform about a first turning point, which is defined by the external member, i.e. the first barrier member will take the initial loading until the first barrier member is deflected in such a way to contact the second barrier member.

Once the first barrier member has deformed so as to contact the second barrier member, then the barrier will begin to deform about a second turning point defined by the second barrier member.

Providing this tiered system provides a surprising effect in that the first barrier member and the second barrier member both individually provide structural support, but combine together to be able to resist a loading that is greater than the sum of the loads resisted individually by the first barrier member and the second barrier member.

Figure 1:
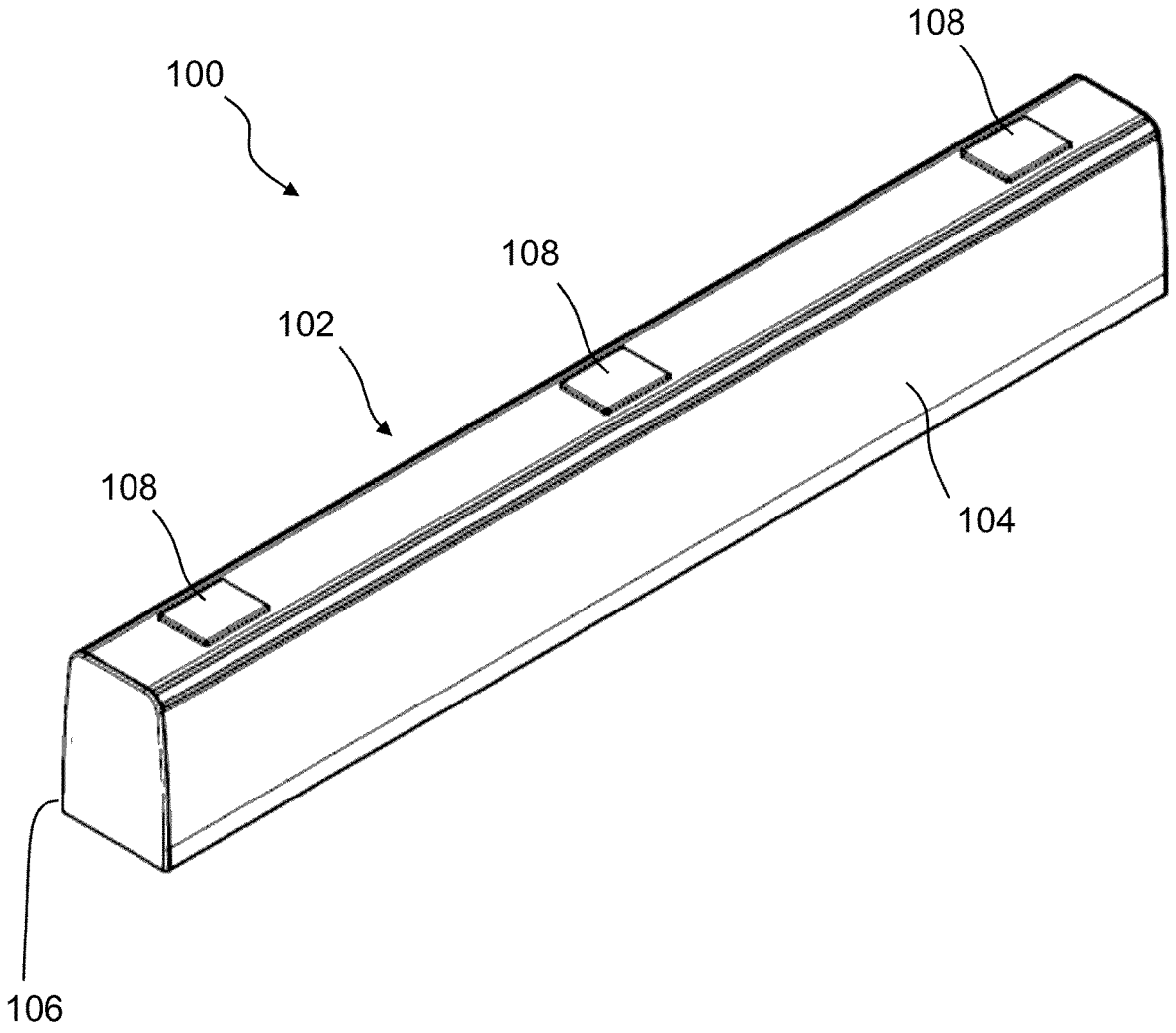
FIG. 1 shows an example of a perspective view of a kerb barrier.

FIG. 1 shows a perspective view of an example of a kerb barrier 100. In this example, the first barrier member 102 is shown. A second barrier member (not shown) is located within a cavity of the first barrier member 102.

The first barrier member 102 may be substantially box shaped and have a substantially polygonal cross-section. A wall 104 of the first barrier member 102 is shown in FIG. 1. The first barrier member 102 may include an end cap 106 to cap off the end of the first barrier member 102 and hide the second barrier member, in use. The end cap 106 may be removable such that, if required, an engineer may remove the end cap 106 to access the second barrier member.

A plurality of covers or caps 108 are also shown in FIG. 1. These are designed to cover one or more fixings that couple the first barrier member to the second barrier member, in use. These are discussed in more detail below.

Figure 2A:
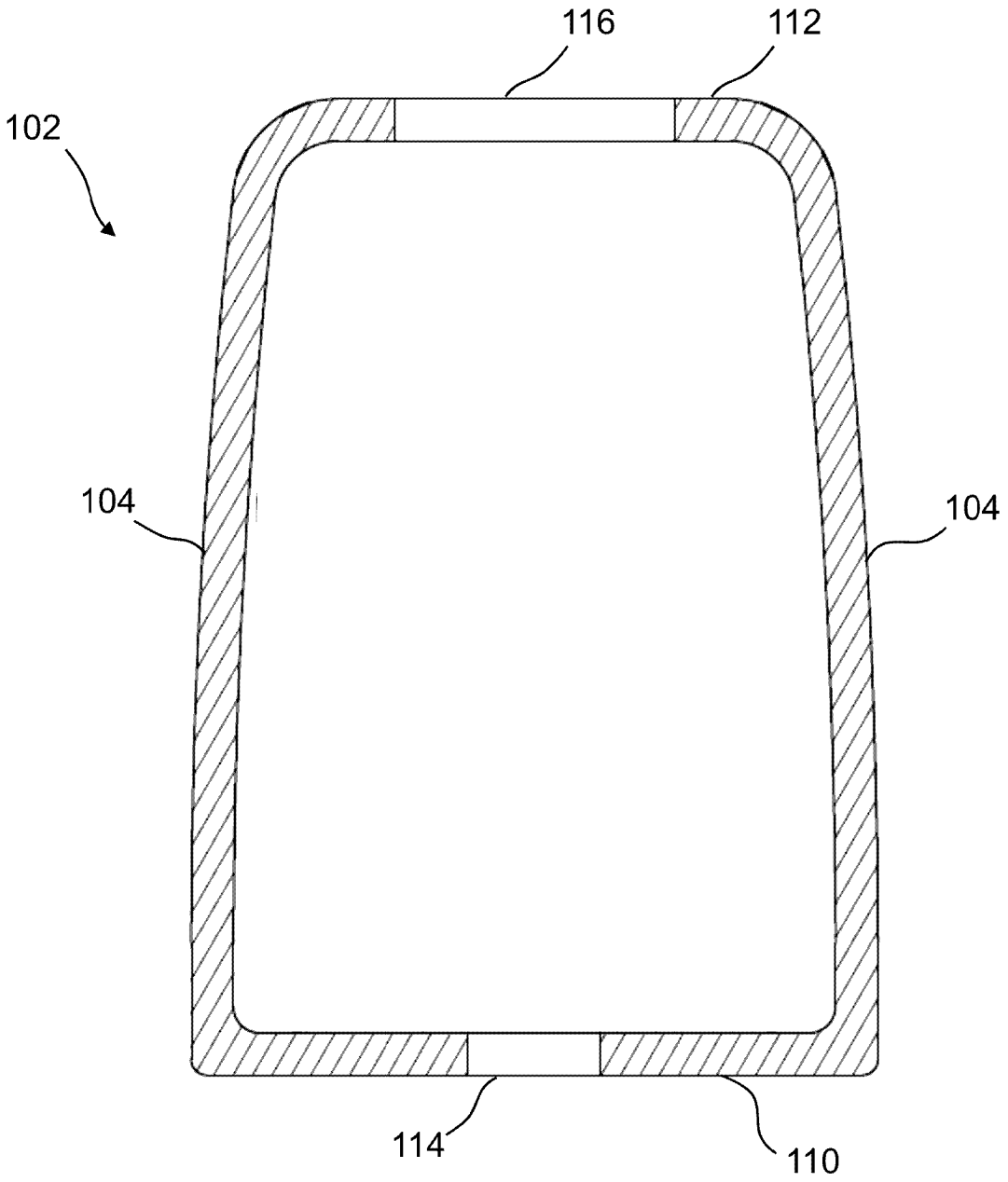
FIG. 2A shows a cross-section of an example of a first barrier member.

FIG. 2A shows an example of a cross-section of the first barrier member 102. In this example, the second barrier member has been removed for clarity. The first barrier member 102 may include a plurality of walls 104 that extend from a base 110. In use, the first barrier member 102 is configured to be placed on the ground or floor such that the base 110 may be directly supported on the ground or floor in use. A top 112 or ceiling of the first barrier member 102 may extend between the top of the walls 104 to close off the first barrier member 102.

The base 110 may define one or more base apertures 114 along the length of the first barrier member 102. Further, the top 112 may define one or more top apertures 116 along the length of the first barrier member 102. The base apertures 114 are co-located with the top apertures 116 such that one or more fixings may be inserted through the top apertures 116 and the base apertures 114 to couple the barrier 100 to the ground.

Figure 2B:
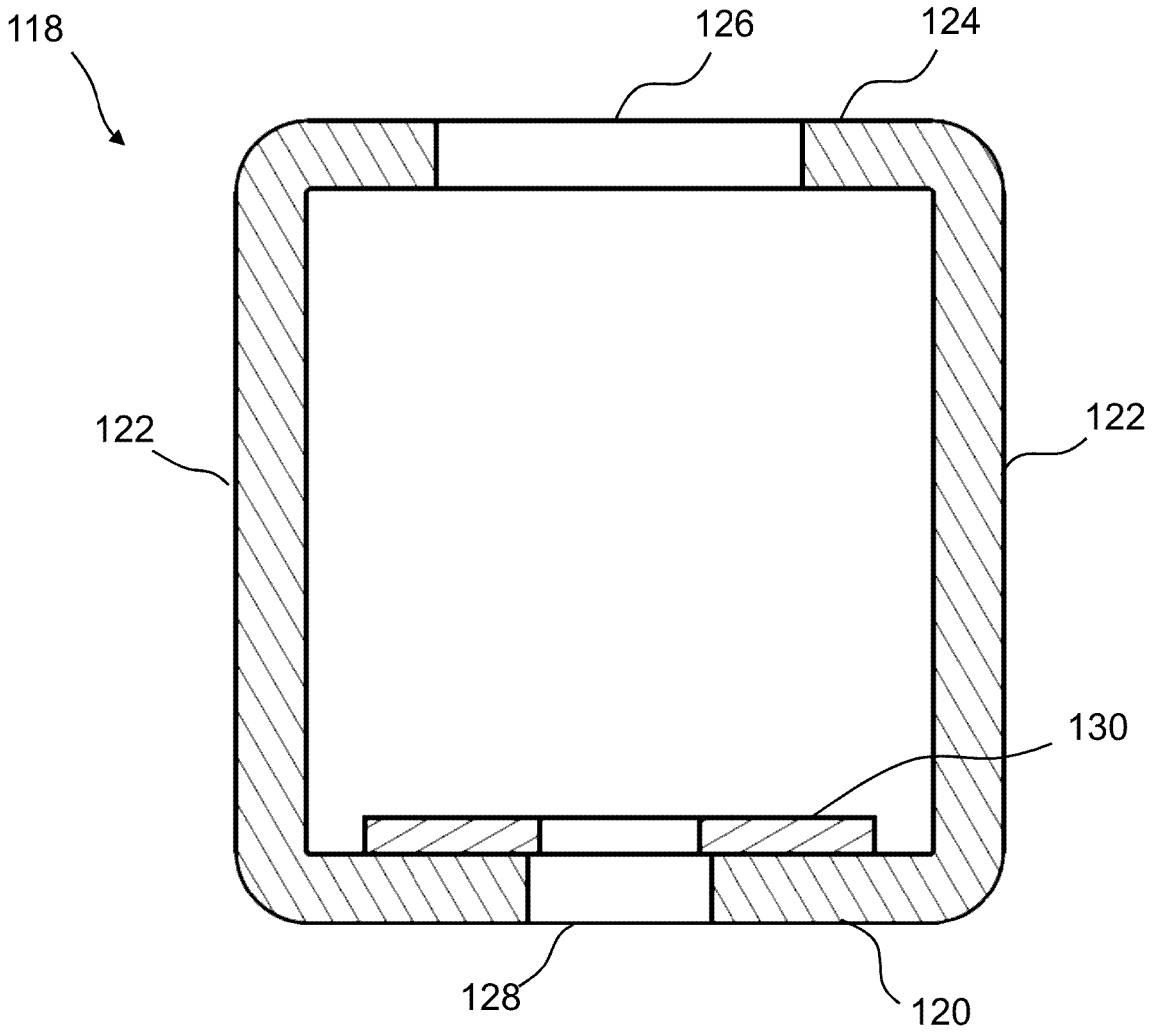
FIG. 2B shows cross-section of an example of a second barrier member.

FIG. 2B shows an example of a cross-section of the second barrier member 118. In this example, the first barrier member 102 has been removed for clarity. The second barrier member 102 may include a plurality of walls 122 that extend from a base 120. In use, the base 120 of the second barrier member 118 is configured to be placed on the base 110 of the first barrier member 102

A top 124 or ceiling of the second barrier member 118 may extend between the top of the walls 122 to close off the second barrier member 118.

The base 120 of the second barrier member 118 may define one or more base apertures 128 along the length of the second barrier member 118. Further, the top 124 may define one or more top apertures 126 along the length of the second barrier member 118. The base apertures 128 are co-located with the top apertures 126, such that one or more fixings may be inserted through the top apertures 126 and the base apertures 128 to couple the barrier 100 to the ground.

The base 120 of the second barrier member 118 may also comprise a washer 130 that is supported on the base 120 of the second barrier member 118. The washer 130 is positioned to spread the load from a fixing (not shown) to the second barrier member 118 and the first barrier member 102, when the first barrier member 102 is coupled with the second barrier member 118.

Figure 3:
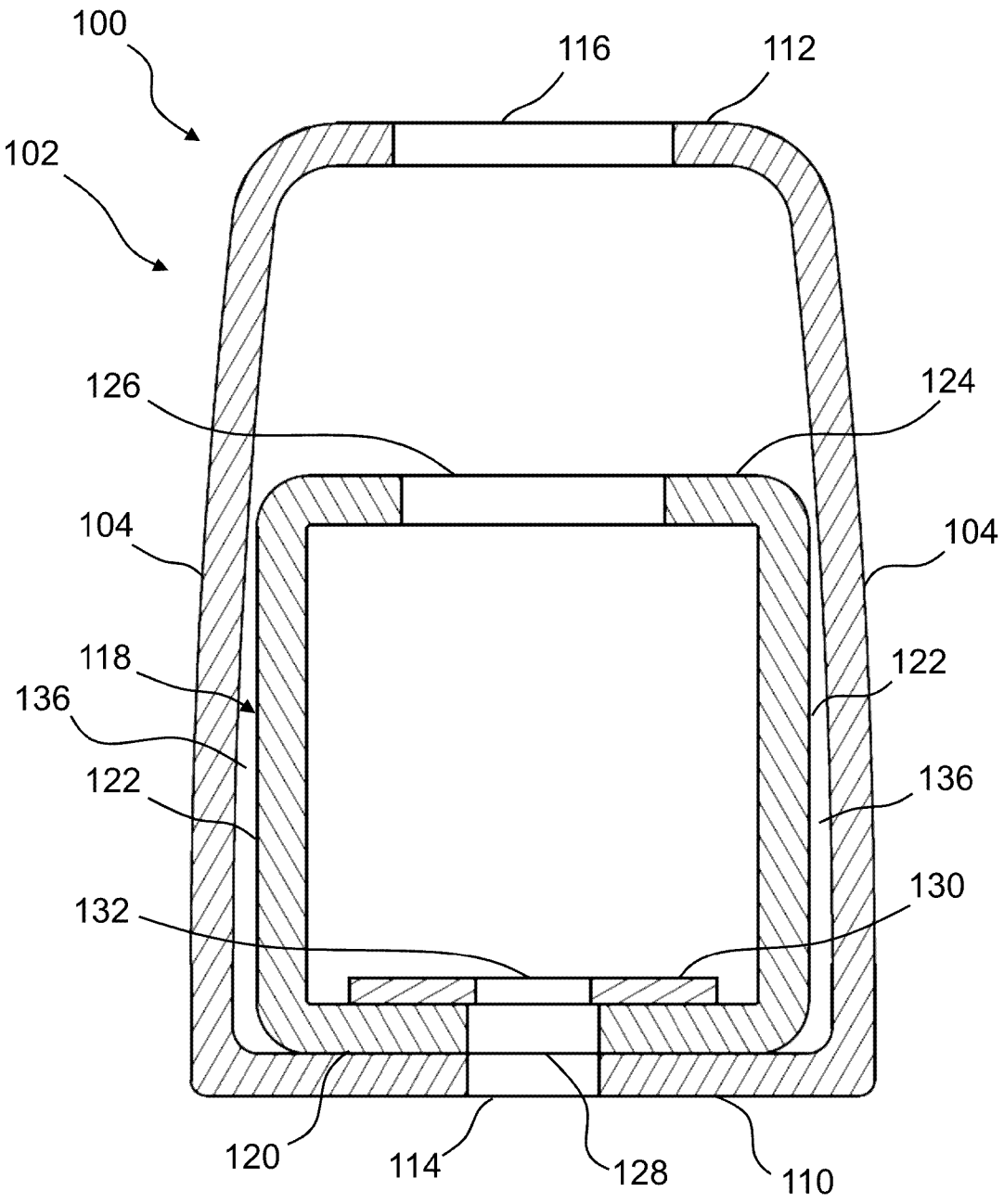
FIG. 3 shows a cross-section of an example of a kerb barrier.

FIG. 3 shows a cross-section of the kerb barrier 100 with the second barrier member 118 located within a cavity of the first barrier member 102. For clarity, the fixings have been removed from FIG. 3, but the opening 116 in the top 112 of the first barrier member 102 is aligned with the opening 126 in the top 124 of the second barrier member 118, the opening 132 in the washer 130, the opening 128 in the base 120 of the second barrier member 118 and the opening 114 in the base 110 of the first barrier member 102. As such, a fixing can extend through all of these openings and be connected to a coupling point in the ground.

The base 120 of the second barrier member 118 is configured to abut or be supported on the base 110 of the first barrier member 102. However, the other components of the first barrier member 102, such as the walls 104 and top 112 are configured to be separated from the other components of the second barrier member 118. In other words, in an undeformed state, a clearance gap 136 is provided between a wall 104 of the first barrier member 102 and a wall 122 of the second barrier member 118. A clearance gap 136 is also provided between the top 112 of the first barrier member 102 and the top 124 of the second barrier member 118. As will be shown in more detail below, the clearance gap 136 is facilitates the first barrier member 104 to deform or bend relative to the base 110 of the first barrier member 102. The clearance gap 136 also facilitates the first barrier member 104 to deform or bend relative to the second barrier member 118.

In one example, the second barrier member 118 comprises a polygonal section. For example, the second barrier member 118 comprises a square hollow section. In other examples, the second barrier member 118 is cylindrical. For example, the second barrier member 118 may comprise a circular hollow section, that abuts the base 110 of the first barrier member 102.

The first barrier member 102 may comprise a polygonal hollow section.

In one example, the first barrier member 102 tapers from the base 110 to a top 112 or ceiling of the first barrier member 102. The taper means that if a fork of a vehicle hits the kerb barrier 100, then the fork will be deflected upwards, diverting some horizontal energy into vertical energy. If the wheels hit the kerb barrier 100, then they will be lifted upwards too.

In this example, the first barrier member 102 defines a cavity in which the second barrier member 118 is located. The second barrier member 118 extends substantially along the length of the first barrier member 102. That is to say that the length of the first barrier member 102 is substantially the same as the length of the second barrier member 118. In other words, the second barrier member 118 is almost the same length as the first barrier member 102. The second barrier member 118 is not merely used as a coupling member to join together two distinct first barrier members 102, but rather, the second barrier member 118 extends substantially throughout the first barrier member 102 and provides significant structural support to the kerb barrier 100.

The base 110 of the first barrier member 102 is configured to support the base 120 of the second barrier member 118 and they may be coupled together via a fixing.

In one example, the first barrier member and the second barrier member are extruded sections. However, they may be manufactured in alternative means, for example by injection moulding, 3D printing or machining.

Figure 4A:
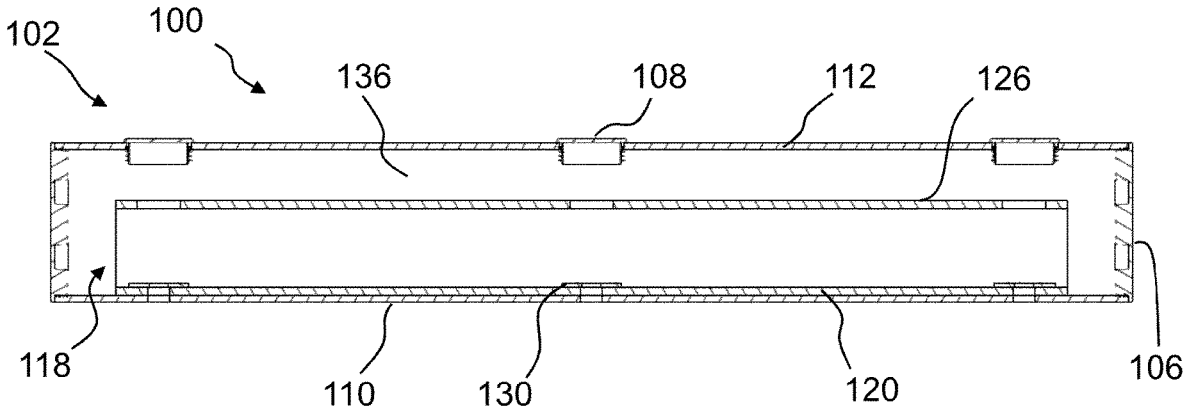
FIG. 4A shows a cross-section of an example of a kerb barrier through a different section.

FIG. 4A shows an example of a cross section through the kerb barrier 100 through a longitudinal axis of the kerb barrier 100. As shown in FIG. 4A, the second barrier member 118 extends substantially along the whole length of the first barrier member 102. A clearance gap 136 is provided between the first barrier member 102 and the second barrier member 118.

Figure 4B:
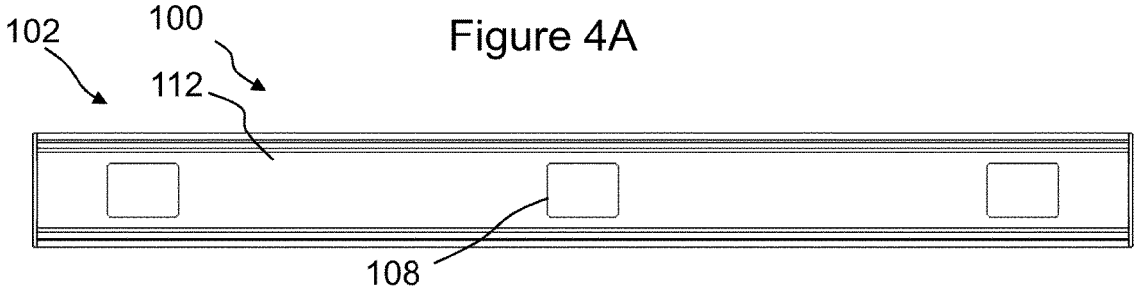
FIG. 4B shows a top view of an example of a kerb barrier.

FIG. 4B shows a top view of the barrier kerb 100. The top 112 of the first barrier member 102 is shown in addition to the caps 108. In use, the caps 108 will cover one or more of the fixings, in use. In this example, three caps 108 are used, but other example may comprise more or fewer than three caps 108.

Figure 4C:
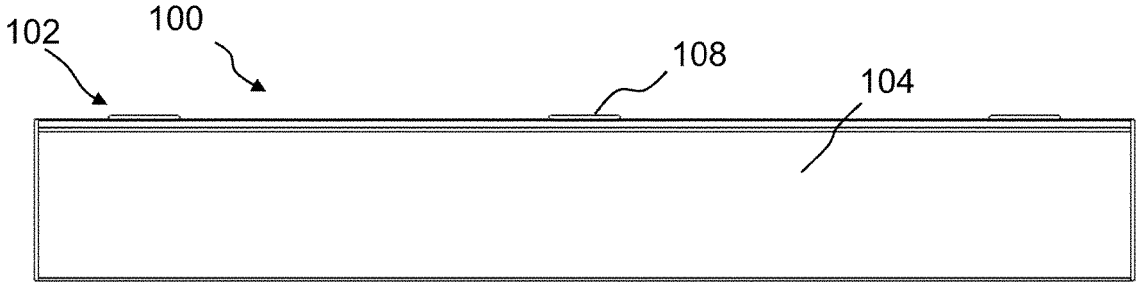
FIG. 4C shows a side view of an example of a kerb barrier.

FIG. 4C shows a side elevation of the barrier kerb 100. One of the walls 104 of the first barrier member 102 is shown.

Figure 4D:
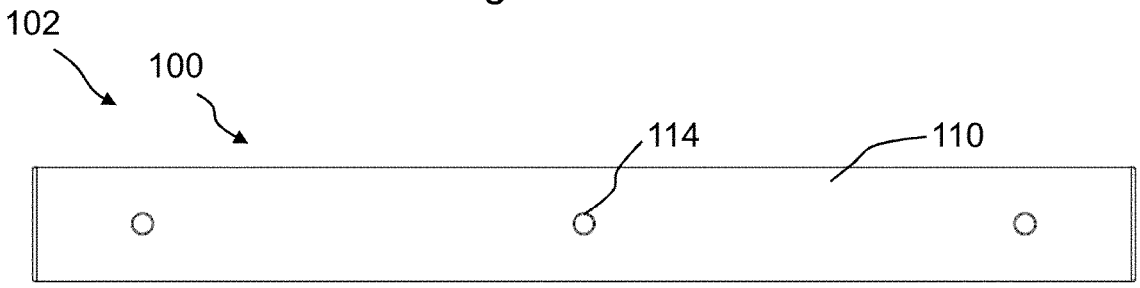
FIG. 4D shows a bottom view of an example of a kerb barrier.

FIG. 4D shows a bottom view of the barrier kerb 100. In this example, the first barrier member 102 comprises three openings 114 in the base 110 of the first barrier member 102. However, in other examples, there may be more or fewer than three openings 114. The openings 114 in the base 110 of the first barrier member 102 are circular, however, in other examples the openings 114 may have a polygonal cross section, such as a square cross section.

Figure 5:
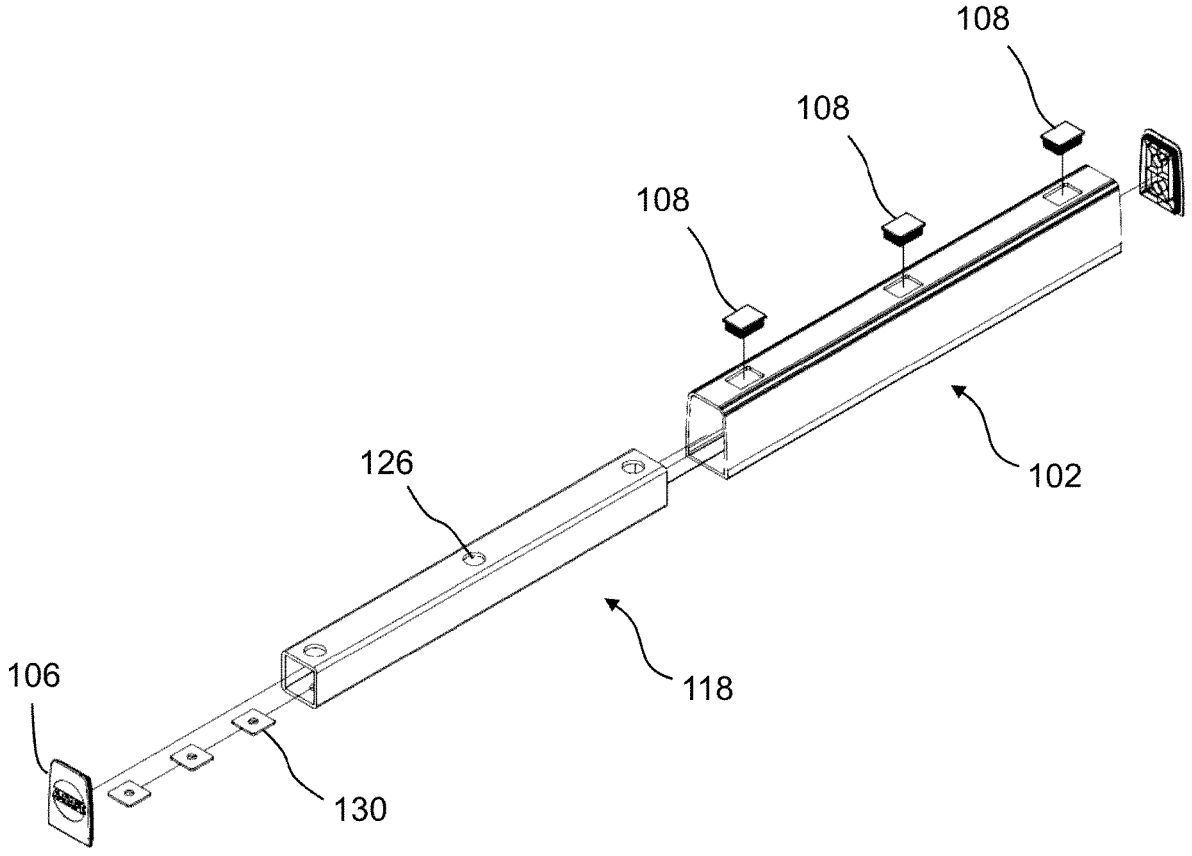
FIG. 5 shows an exploded view of components of a kerb barrier.

FIG. 5 shows an exploded view of the components of the barrier kerb 100.

Figure 6A:
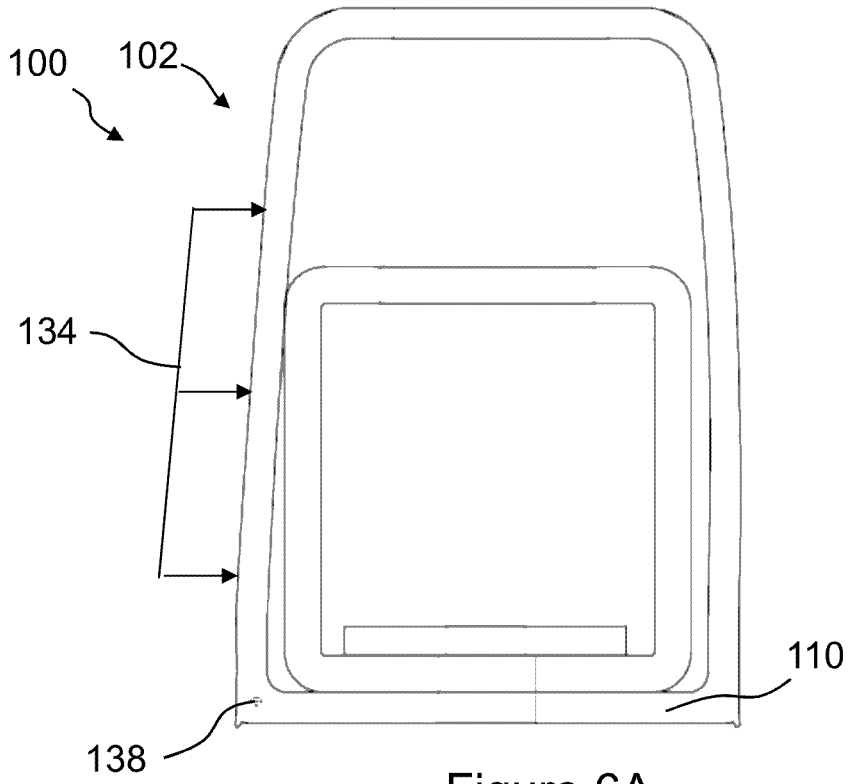
FIG. 6A shows an example of initial deformation of a kerb barrier.

FIG. 6A shows an example of initial deformation of the kerb barrier 100 following a side impact on the wall of the first barrier member 102. The impact is simulated as a loading arrows 134 as shown in the FIG. 6A. The impact may result from a strike from a fork of the forklift truck or from a wheel of a vehicle making contact with the barrier kerb 100. The load applied is approximately equal to 4.5 tonne vehicle travelling at 5 mph. The kerb barrier 100 did not fail at this impact and it is envisaged that the kerb barrier 100 will be able to successfully absorb larger loads without failing.

For clarity, the figures do not show the presence of one or more fixings that would couple the kerb barrier 100 to the ground, in use. As such, the base 110 of the first barrier member 102 and the base 120 of the second barrier member 118 are effectively coupled to the ground at the fixing locations. As such, any side loading, for example from a vehicle impact, will effectively act about this fixing location.

In one example, the fixings comprise M20 bolts. The fixings may be received in concrete in the ground. Other sizes of bolts and other types of fixings, such as dowels are envisaged.

In this example, a region of the first barrier member 102 is configured to bend relative to the second barrier member 118 about a first bending point 138 defined by the first barrier member 102. In this example, region of the first barrier member 102 that bends relative to the second barrier member 118 is a wall 104 (or part of a wall 104) of the first barrier member 102. In one example, the first bending point 138 of the first barrier member 102 is at the junction between the wall 104 and the base 110 of the first barrier member 102. The region of the first barrier member 102 is configured to bend about the first bending point 138 because the corner of the first barrier member 102 has a relatively high stiffness compared with the rest of the wall 104. In this example, when a load 134 is applied as shown, the wall 104 will bend about the first bending point 138 because this is a relatively stiff point in the first barrier member 102.

If the load applied is sufficient, the region of the first barrier member 102 moves relative to the second barrier member 118 such that contact is made between the first barrier member 102 and the second barrier member 118. In other words, the clearance gap 136 is taken up by the region of the first barrier member 102 that has been deflected, which is in this case, part of the wall 104 of the first barrier member 102.

Following contact between the first barrier member 102 and the second barrier member 118, the kerb barrier 100 will continue to deform if the load applied is sufficiently high in a second stage of deformation.

In this second stage, the first barrier member 102 and the second barrier member 118 will deform together about a second bending point 140. The second bending point 140 is defined by the second barrier member 118. In this example, the second bending point 140 is defined by the junction of the wall 122 of the second barrier member 118 and the base 120 of the second barrier member 118. This junction represents a relatively stiff point in the second barrier member 118. As such, the second barrier member 118 will deform about this stiff point, second bending point 140. As the first barrier member 102 and the second barrier member 118 are in contact, both the first barrier member 102 and the second barrier member 118 will deflect about the second bending point 140.

Figure 6B:
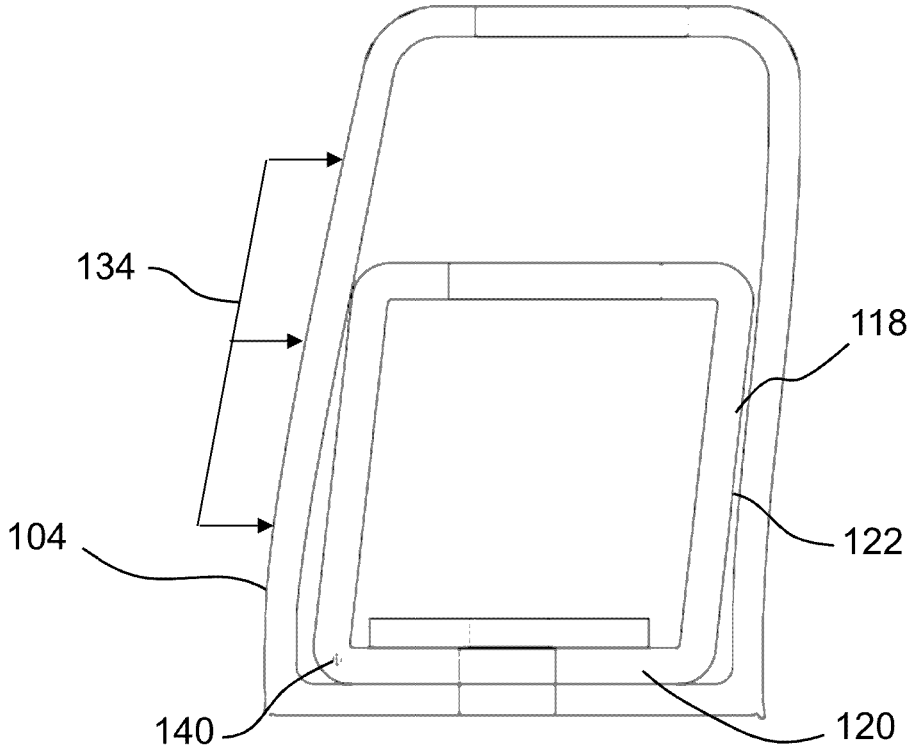
FIG. 6B shows an example of subsequent deformation of a kerb barrier.

As shown in FIGS. 6A and 6B, the first bending point 138 and the second bending point 140 of the kerb barrier 100 are spaced apart from each other. One reason for this is that the first bending point 138 is defined by the first barrier member 102 whereas the second bending point 140 is defined by the second barrier member 118.

The provision of multiple bending points about which the elements of the kerb barrier 100 bend significantly increase the strength of the kerb barrier 100. This is contrary to traditional thinking in which walls of internal members are configured to abut walls of external members in an undeformed state. In this traditional thinking, only a single bending point would be present in contrast with the at least two bending points provided by the present invention.

Providing at least two bending points surprisingly increases the overall loads that can be effectively absorbed by the barrier kerb without breaking.

Figure 6C:
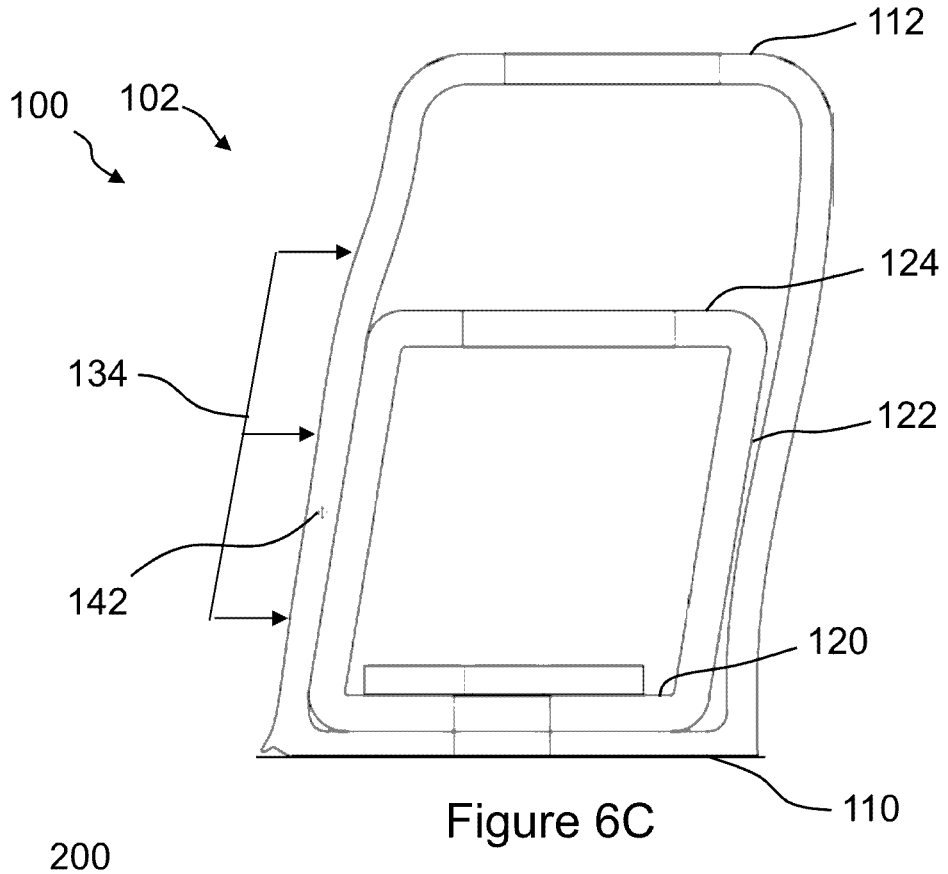
FIG. 6C shows an example of subsequent deformation of a kerb barrier.

If the load applied to the kerb barrier is sufficient to further deform the structure, then the next stage of the deformation is shown in FIG. 6C.

In this third stage, the first barrier member 102 bends about a third bending point 142. The third bending point 142 may not necessarily be located at a junction between a wall 104 of the first barrier member 102 and the base 110 or top 112 of the first barrier member 102.

In one example, the third bending point 142 is located in the first barrier member 102 approximately midway between the base 120 of the second barrier member 118 and the top 124 of the second barrier member 118. The reason for this is that these are effectively two support points for the wall 104 of the first barrier member 102 during this phase and so the maximum bending moment will be located between these points. Bending of the first barrier member 102 about this point means that the wall 104 of the first barrier member 102 effectively abuts the wall 122 of the second barrier member 118 along this region.

In other words, upon side impact, a region of the first barrier member 102, such as the wall 104 of the first barrier member 102 is configured to bend relative to the second barrier member 118 about a first bending point 138 defined by the first barrier member 102. Following the side impact, the first barrier member 102 is configured to act on the second barrier member 118 such that the region of the first barrier member 102 and a region of the second barrier member 118 are configured to bend about a second bending point 140 defined by the second barrier member 118.

Importantly, the second bending point 140 is spaced apart from the first bending point 138. The first bending point 138 and the second bending point increases the overall strength of the kerb barrier 100 because it enabled more energy to be absorbed by the kerb barrier 100 without failure.

Figure 7A:
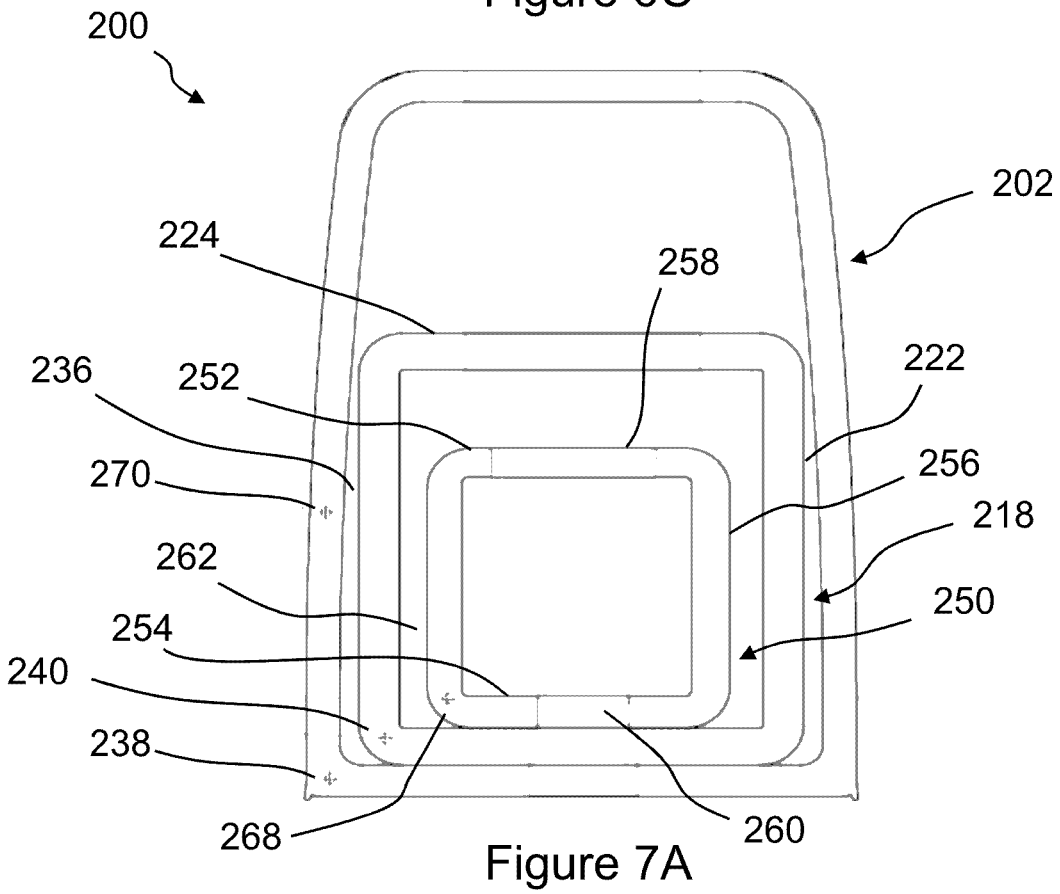
FIG. 7A shows a cross-section of an example of a kerb barrier.

FIG. 7A shows another example of a kerb barrier 200. In this example, reference signs are similar to the reference signs used in FIGS. 1 to 6C, with an increment of 100. Note that not all of the reference signs have been included for clarity.

The kerb barrier 200 shown in FIG. 7A is identical to the kerb barrier 100 shown in FIGS. 1 to 6C, with the addition of a third barrier member 250. In other words, the kerb barrier 200 includes a first barrier member 202, a second barrier member 218 located within the first barrier member 202 and a third barrier member 250 located within a cavity of the second barrier member 218. The third barrier member 250 may extend substantially along the length of the second barrier member. In other words, the third barrier member 250 is substantially the same length as the second barrier member 218.

The first barrier member 202 and the second barrier member 218 are substantially identical to the first barrier member 102 and the second barrier member 118 as shown in FIG. 3.

The third barrier member 250 may include a base 254, a top 252 and one or more walls 256. The base 254 of the third barrier member 250 is supported on the base 120 of the second barrier member 218. In other words, the base 254 of the third barrier member 254 abuts the base 220 of the second barrier member 218.

However, the other components of the third barrier member 250, such as the walls 256 and top 252 are configured to be separated from the other components of the second barrier member 218. In other words, a clearance gap 262 is provided between a wall 256 of the third barrier member 250 and a wall 222 of the second barrier member 218. A clearance gap 262 is also provided between the top 252 of the third barrier member 250 and the top 224 of the second barrier member 218. As will be shown in more detail below, the clearance gap 262 is required to enable the third barrier member 250 to deform or bend relative to the base 254 of the third barrier member 250. The clearance gap 262 also enables the second barrier member 218 to deform or bend relative to the third barrier member 250.

In one example, the third barrier member 250 comprises a polygonal hollow section.

Figure 7B:
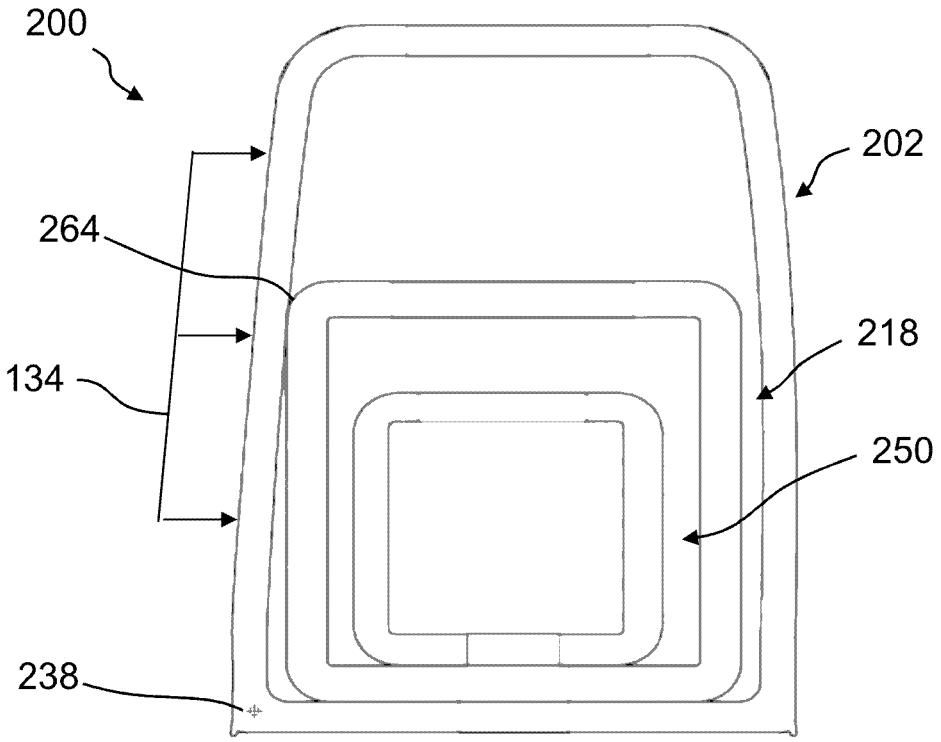
FIG. 7B shows an example of initial deformation of a kerb barrier.

FIG. 7B shows an example of initial deformation of the kerb barrier 200 following a side impact on the wall of the first barrier member 202. The impact is simulated as a loading arrows 134 as shown in the FIG. 7B. The impact may result from a strike from a fork of the forklift truck or from a wheel of a vehicle contacting the barrier kerb 200. The load applied is approximately equal to 4.5 tonne vehicle travelling at 5 mph. The kerb barrier 100 did not fail at this impact and it is envisaged that the kerb barrier 100 will be able to successfully absorb larger loads without failing.

In this example, a region of the first barrier member 202 is configured to bend relative to the second barrier member 218 about a first bending point 238 defined by the first barrier member 202. In this example, region of the first barrier member 202 that bends relative to the second barrier member 218 is a wall 204 (or part of a wall 204) of the first barrier member 202. The region of the first barrier member 202 is configured to bend about the first bending point 238 because the corner of the first barrier member 202 has a relatively high stiffness compared with the rest of the wall 204. In this example, when a load 234 is applied as shown, the wall 204 will bend about the first bending point 238 because this is a relatively stiff point in the first barrier member 202.

If the load applied is sufficient, the region of the first barrier member 202 moves relative to the second barrier member 218 such that contact is made between the first barrier member 202 and the second barrier member 218. In other words, the clearance gap 236 is taken up by the region of the first barrier member 202 that has been deflected, which is in this case, part of the wall 204 of the first barrier member 202.

In this example, the first barrier member 202 contacts the second barrier member 218 at a first contact point 264 as the region of the first barrier member 202 bas bent about the first bending point 238.

Following contact between the first barrier member 202 and the second barrier member 218 at the first contact point 264, the kerb barrier 200 will continue to deform if the load applied is sufficiently high in a second stage of deformation.

In this second stage, the first barrier member 202 and the second barrier member 218 will deform together about a second bending point 240. The second bending point 240 is defined by the second barrier member 218. In this example, the second bending point 240 is defined by the junction of the wall 222 of the second barrier member 218 and the base 220 of the second barrier member 218. This junction represents a relatively stiff point in the second barrier member 218. As such, the second barrier member 218 will deform about this stiff point, second bending point 240. As the first barrier member 202 and the second barrier member 218 are in contact, both the first barrier member 202 and the second barrier member 218 will deflect about the second bending point 240.

The first barrier member 202 and the second barrier member 218 will deform in this fashion until the second barrier member 218 contacts the third barrier member 250 at a second contact point 266.

Figure 7C:
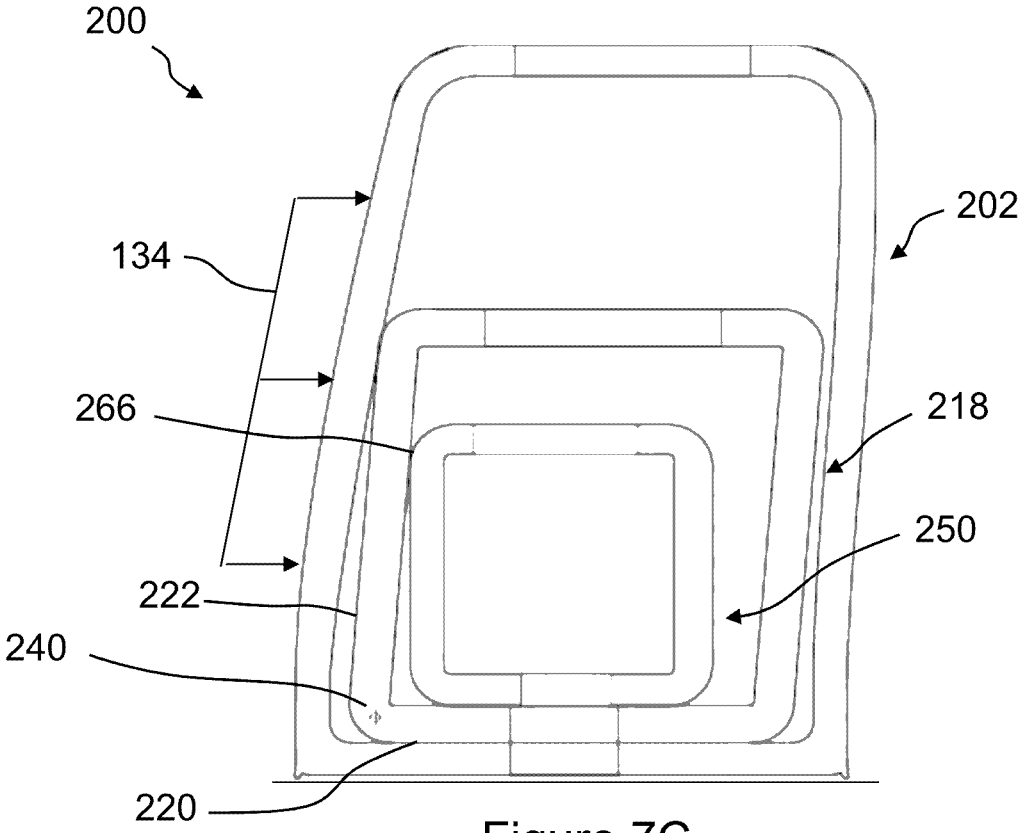
FIG. 7C shows an example of subsequent deformation of a kerb barrier.

As shown in FIGS. 7B and 7C, the first bending point 238 and the second bending point 240 of the kerb barrier 200 are spaced apart from each other. One reason for this is that the first bending point 238 is defined by the first barrier member 202 whereas the second bending point 240 is defined by the second barrier member 218.

The provision of multiple bending points about which the elements of the kerb barrier 200 are configured to bend significantly increase the strength of the kerb barrier 200. This is contrary to traditional thinking in which walls of internal members are configured to abut walls of external members in an undeformed state. In this traditional thinking, only a single bending point would be present in contrast with the at least two bending points provided by the present invention.

Providing at least two bending points surprisingly increases the overall loads that can be effectively absorbed by the barrier kerb without breaking.

Figure 7D:
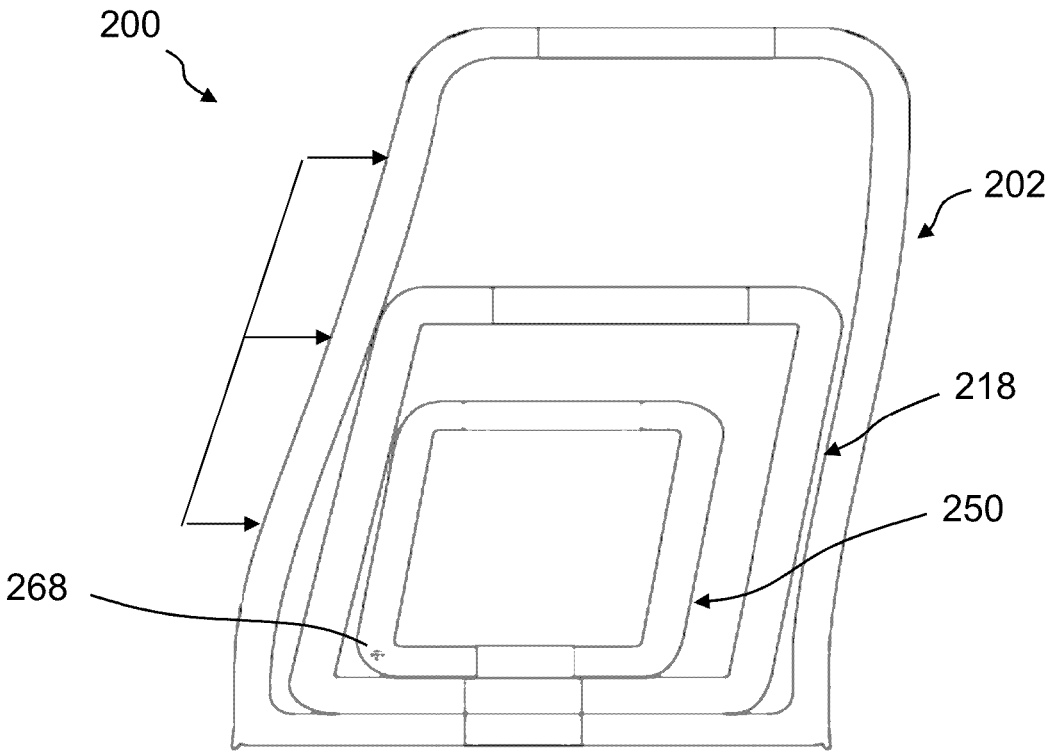
FIG. 7D shows an example of subsequent deformation of a kerb barrier.

If the load applied to the kerb barrier is sufficient to further deform the structure, then the next stage of the deformation is shown in FIG. 7D.

In this third stage, the first barrier member 202, the second barrier member 218 and the third barrier member 250 bend about a third bending point 268 defined by the third barrier member 250.

The third bending point 268 may be located at a junction between a wall 256 of the third barrier member 250 and the base 254 or top 252 of the third barrier member 250. The third bending point 268 is spaced apart from the first bending point 238 and the second bending point 240. Providing a third bending point 268 that is spaced apart from the first bending point 238 and the second bending point 240 surprisingly increases the overall loads that can be effectively absorbed by the barrier kerb 200 without breaking.

Figure 7E:
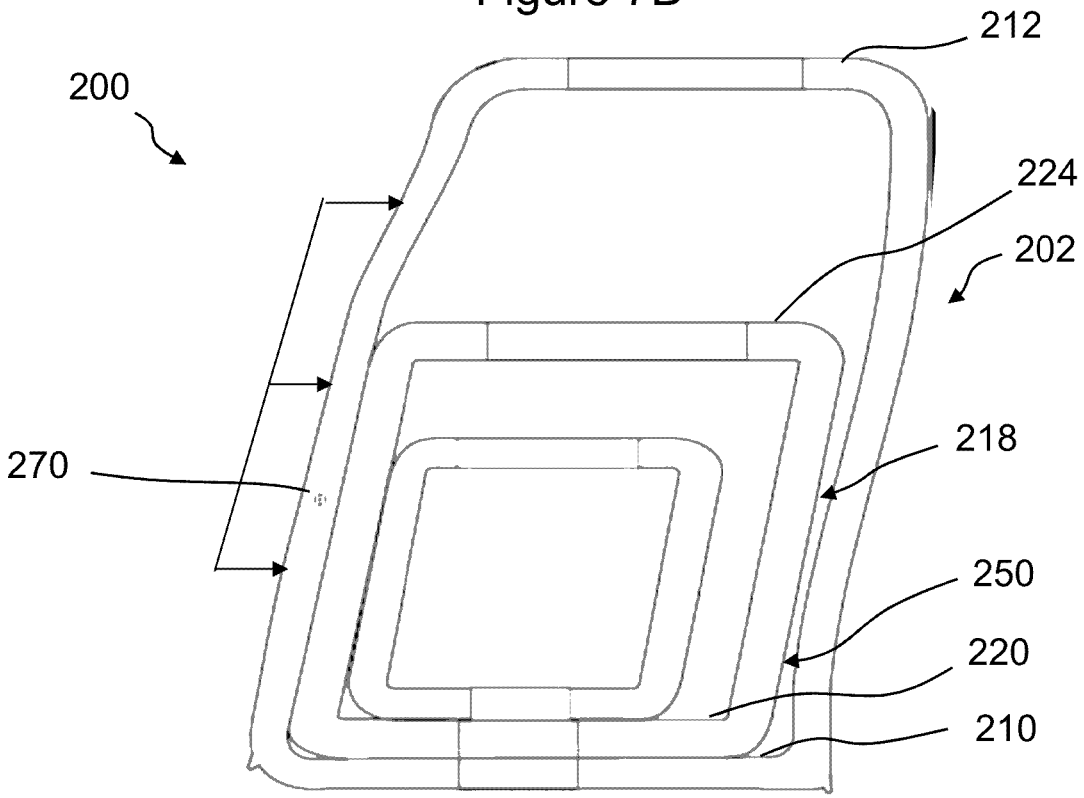
FIG. 7E shows an example of subsequent deformation of a kerb barrier.

If the load applied to the kerb barrier is sufficient to further deform the structure, then the next stage of the deformation is shown in FIG. 7E.

In this fourth stage, the first barrier member 202 bends about a fourth bending point 270. The fourth bending point 270 may not necessarily be located at a junction between a wall 204 of the first barrier member 202 and the base 210 or top 212 of the first barrier member 202.

In one example, the fourth bending point 270 is located in the first barrier member 202 approximately midway between the base 220 of the second barrier member 218 and the top 224 of the second barrier member 218. The reason for this is that these are effectively two support points for the wall 204 of the first barrier member 202 during this phase and so the maximum bending moment will be located between these points. Bending of the first barrier member 202 about this point means that the wall 204 of the first barrier member 202 effectively abuts the wall 222 of the second barrier member 218 along this region.

In one example, one or more of the the first barrier member 102, 202, the second barrier member 118, 228 and the third barrier member 250 are made of Polyurethane.

In practice, a plurality of kerb barriers 100, 200 may be coupled together. In other words, a system of a plurality of kerb barriers 100, 200 may be coupled together to form various arrangements of kerb barriers 100, 200.

Experiments were conducted to assess the effectiveness of the kerb barrier 100, as shown in FIGS. 3 to 6C.

Tests for were undertaken with a Still FM-X 25 reach fork lift truck.

In summary, the kerb barrier 100 was impacted by a fork lift truck travelling with various energies to test how the kerb barrier performed. In all tests, a fork lift truck approximately equal to 4.5 tonne vehicle travelling at 5 mph impacts the kerb barrier 100. The kerb barrier 100 did not fail at this impact and it is envisaged that the kerb barrier 100 will be able to successfully absorb larger loads without failing.

It was noticeable that the fork lift truck was at zero velocity for an extended period of time. In this test, the forward energy was partly converted to vertical energy as the front of the fork lift rose during impact and the rebound started as the for lift returned to horizontal.

In the tests, the kerb barrier 100 performed far better than existing products, which typically only are able to stop vehicles with energies of up to 5,000 J.

In isolation, the first barrier member 102 is configured to absorb an energy of approximately 3,000 J without failing and the second barrier member 118 is configured to absorb an energy of approximately 3,000 J without failing. However, combining them together in the way described above results in a kerb barrier that is able to absorb more energy than the sum of the energies absorbed individually by the first barrier member 102 and the second barrier member 118.

The kerb barrier 100, 200 could be used in a number of different situations. For example, it could be used in a factory in which vehicles operate. The kerb barrier barrier 100, 200 could also be used in a car park, for example, at the end of a parking bay.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A kerb barrier comprising:

a first barrier member having a length, the first barrier member defining a cavity; and a second barrier member in the cavity of the first barrier member that extends substantially along the length of the first barrier member, wherein a base of the second barrier member is fixable to a base of the first barrier member, wherein, upon side impact, a region of the first barrier member is configured to bend relative to the second barrier member about a first bending point defined by the first barrier member, wherein the first barrier member is configured to act on the second barrier member such that the region of the first barrier member and a region of the second barrier member are configured to bend about a second bending point defined by the second barrier member, wherein the second bending point is spaced apart from the first bending point wherein, in an undeformed state, a clearance gap is provided between a wall of the first barrier member and a wall of the second barrier member.

2. The kerb barrier according to claim 1, wherein the region of the first barrier member that is configured to bend is the wall of the first barrier member, and wherein, upon side impact, the wall of the first barrier member is configured to move relative to the wall of the second barrier member to contact the wall of the second barrier member.

3. The kerb barrier according to claim 1, wherein the first barrier member tapers from the base to a top of the first barrier member.

4. The kerb barrier according to claim 1, wherein the first bending point is located at a junction of the wall and the base of the first barrier member.

5. The kerb barrier according to claim 1, wherein the second bending point is located at a junction of the wall and the base of the second barrier member.

6. The kerb barrier according to claim 1, wherein the second barrier member comprises a cavity, the kerb barrier comprising a third barrier member in the cavity of the second barrier that extends substantially along a length of the second barrier member.

7. The kerb barrier according to claim 6, wherein, upon side impact, the second barrier member is configured to act on the third barrier member such that the region of the first barrier member, the region of the second barrier member and a region of the third barrier are configured to bend about a third bending point defined by the third barrier member, wherein the third bending point is spaced apart from the first bending point and the second bending point.

8. The kerb barrier according to claim 1, comprising a plurality of fixings arranged along the length of the kerb barrier and configured to couple the first barrier member to the second barrier member and the ground.

9. The kerb barrier according to claim 1, wherein the second barrier member comprises a polygonal hollow section.

* * * * *